US007136606B2

(12) United States Patent
Rose et al.

(10) Patent No.: US 7,136,606 B2
(45) Date of Patent: Nov. 14, 2006

(54) FINISHING MODULE WITH A PIVOTABLE MOUNT, FOR USE WITH A COPIER OR DIGITAL PRINTER

(75) Inventors: Gary H. Rose, Brampton (CA); Vicente P. Nunes, Mississauga (CA)

(73) Assignee: Xerox Corporation, Stamford, CT (US)

( * ) Notice: Subject to any disclaimer, the term of this patent is extended or adjusted under 35 U.S.C. 154(b) by 109 days.

(21) Appl. No.: 10/833,771

(22) Filed: Apr. 28, 2004

(65) Prior Publication Data

US 2005/0244186 A1 Nov. 3, 2005

(51) Int. Cl.
*G03G 15/00* (2006.01)

(52) U.S. Cl. ..... 399/107; 399/110

(58) Field of Classification Search ..... 399/107, 399/108, 110, 405, 406, 407, 408, 409, 410
See application file for complete search history.

(56) References Cited

U.S. PATENT DOCUMENTS 4,816,108 A * 3/1989 Beck et al. ..... 156/356
6,249,295 B1 6/2001 Kiyohara et al. ..... 346/134
6,659,454 B1 12/2003 Smith et al. ..... 271/213

* cited by examiner

*Primary Examiner*—Hoan Tran
(74) *Attorney, Agent, or Firm*—R. Hutter

(57) ABSTRACT

A copier or printer is pivotably attached to a finisher module, such as for stapling. A pivotable mount is disposed toward the back of the copier, so that an opening can be formed toward the front of the copier, exposing an interface between the copier and the finisher module. A latch is used to hold the finisher module to the copier in a closed position.

13 Claims, 3 Drawing Sheets

FINISHING MODULE WITH A PIVOTABLE MOUNT, FOR USE WITH A COPIER OR DIGITAL PRINTER

TECHNICAL FIELD

The present application relates to office equipment, such as digital printers or copiers, and "finishing modules," such as to perform folding, stapling, or hole-punching, associated therewith.

BACKGROUND

Digital printers and copiers are familiar in offices. Many models of such printers and copiers (broadly, "output devices," meaning any machine which outputs a sheet) are designed to work with "finishing modules" which accept and finish (e.g., collate, staple, fold, hole-punch, etc.) sheets emitted by the printer. The finishing module is typically an optional, add-on device, i.e., the printer itself is capable of functioning without the finishing module.

The transfer of a sheet output by the printer and acceptance of the sheet by the finishing module must be made with minimal risk of damage to the sheet. Thus, the physical interface between the printer and the finishing module must be designed carefully. Further, if there is a jam or other malfunction in or near the interface, it is desirable to design a configuration which allows easy opening of the interface, so that a jammed sheet may be removed, and a reliable re-closing of the interface.

PRIOR ART

U.S. Pat. No. 6,249,295 discloses a printer with readily detachable modules.

U.S. Pat. No. 6,659,454 discloses an exit tray for accumulating sheets output from a printer. The exit tray has pivotable aspects.

SUMMARY

According to one aspect, there is provided an apparatus for processing sheets, the apparatus associated with an output device, comprising a main body; an attachment member, suitable for rigid attachment to the output device; and a pivotable mount for mounting the attachment member to the main body.

According to another aspect, there is provided an apparatus, comprising an output device, defining a front and a back, and capable of outputting sheets. A finisher module is capable of receiving a sheet output by the output device and performing a finishing function on the sheet. A pivotable mount is disposed between the output device and the finishing module, adjacent the back of the output device and forming an opening at the front of the output device.

DETAILED DESCRIPTION

Figure 1:
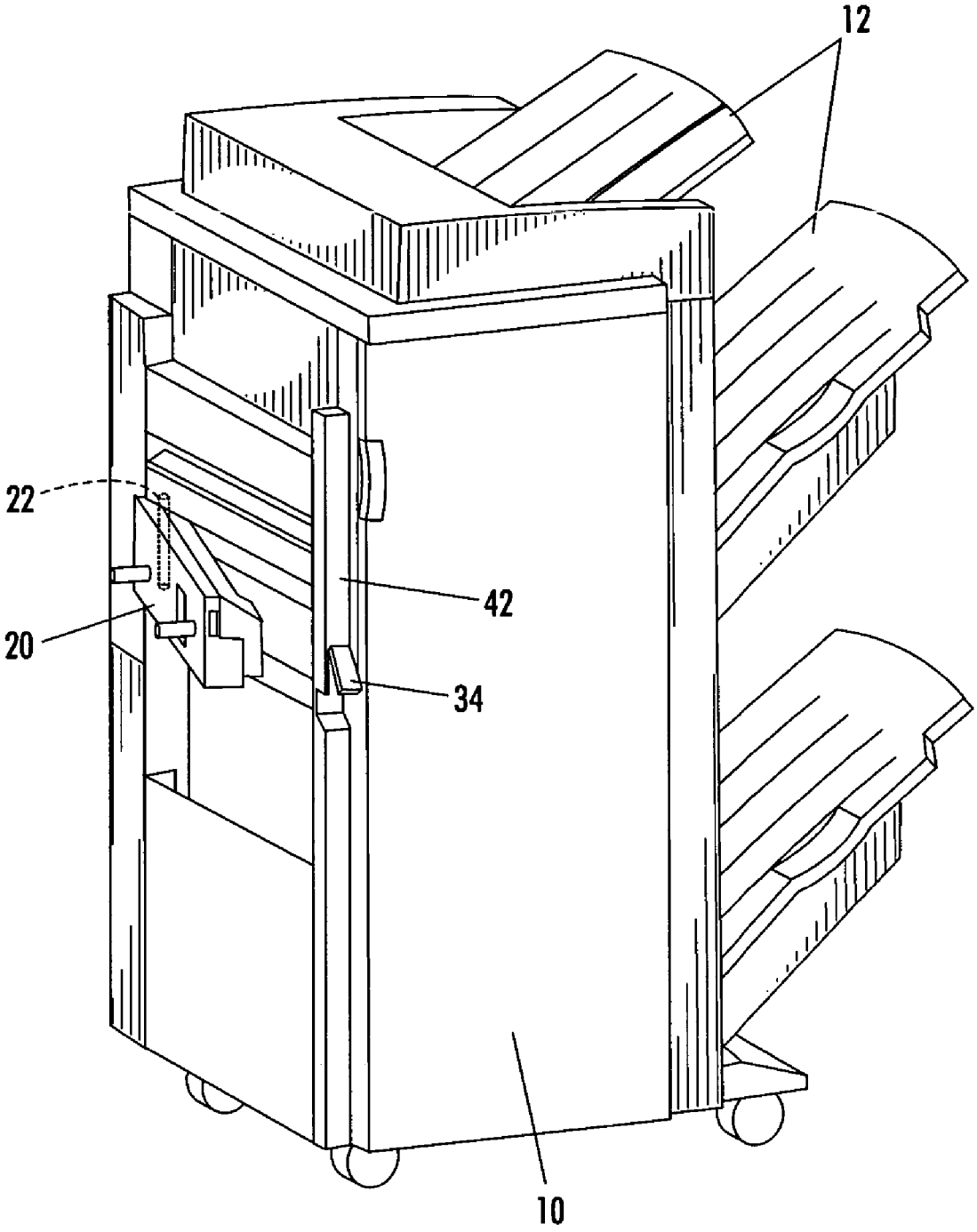
FIG. 1 is a perspective view of a finisher module, in isolation.

FIG. 1 is a perspective view of a finisher module, in isolation. The finisher module in this example is designed to work in conjunction with a mid-range copier or printer (broadly, an "output device," meaning any machine which outputs a sheet). As is familiar in the art, the finisher module may include within its main body 10 a stapler, hole punch, sheet folder, etc., and direct finished sheets or sheet sets to one of various output trays 12. Extending from the main body 10 of the finishing module is an attachment member 20. The attachment member 20 is mounted to the main body 10 by a pivotable mount which may include a hinge 22.

Figure 2:
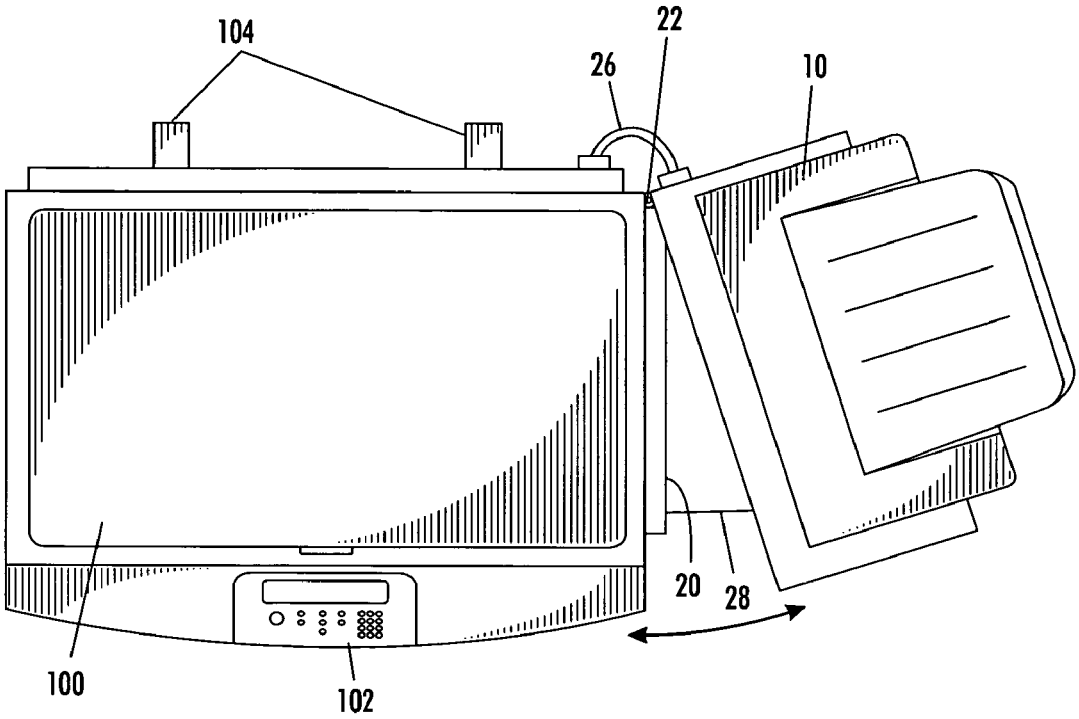
FIG. 2 is a plan view of a finisher module in combination with a copier.

FIG. 2 is a plan view of a finisher module in combination with a copier, indicated as 100. As shown in the Figure, the attachment member 20 of the finisher module is rigidly attached to a portion of the copier 100. Because the attachment member is pivotably mounted, the combined copier and finishing module can be pivoted open, as shown in the Figure. The hinge 22 is disposed at the back of the copier 100 and finisher module 10, the front being defined in this case by the user interface 102 on copier 100. Because the hinge 22 is disposed at the back of the copier 100, when the hinge is open, an opening is thus formed at the front of copier 100.

Because the finisher module-copier combination can be pivotably opened, a sheet can be manually removed from the interface between the finisher module 10 and copier 100 without fully separating finisher module 10 and copier 100. After the sheet is removed, the combination can be readily closed while preserving a proper alignment between finisher module 10 and copier 100.

Further as shown in FIG. 2, the opening angle between finisher module 10 and copier 100 can be limited by a constraint, such as a wire 28 disposed between main body 10 and attachment member 20. (A constraint could be provided associated directly with the hinge 22 as well.) It is often desirable that the opening angle be no larger than necessary to enable manual sheet removal; a large opening angle might interfere with the placement, on the floor, of the copier 100. Many designs of copier or printer include bumpers, such as 104, on the back, to maintain a necessary ventilation space between the machine and a wall; in one embodiment, the constraint 28 is designed to prevent a back surface of the finisher module from extending beyond the back bumpers 104 of copier 100.

In one possible embodiment, the attachment member can be attached to the copier 100 by screws, for an essentially permanent attachment. In another embodiment, the attachment member 22 can attach to the copier 100 by means of one or more latches. "Latch" will here be defined as any device, or portion of a device, which effects a substantially rigid, but readily undoable, attachment between two bodies. The latch may include mechanical, electromechanical, or magnetic aspects, as well as adhesive-like properties, such as including semi-permanent adhesives or Velcro®.

Figure 3:
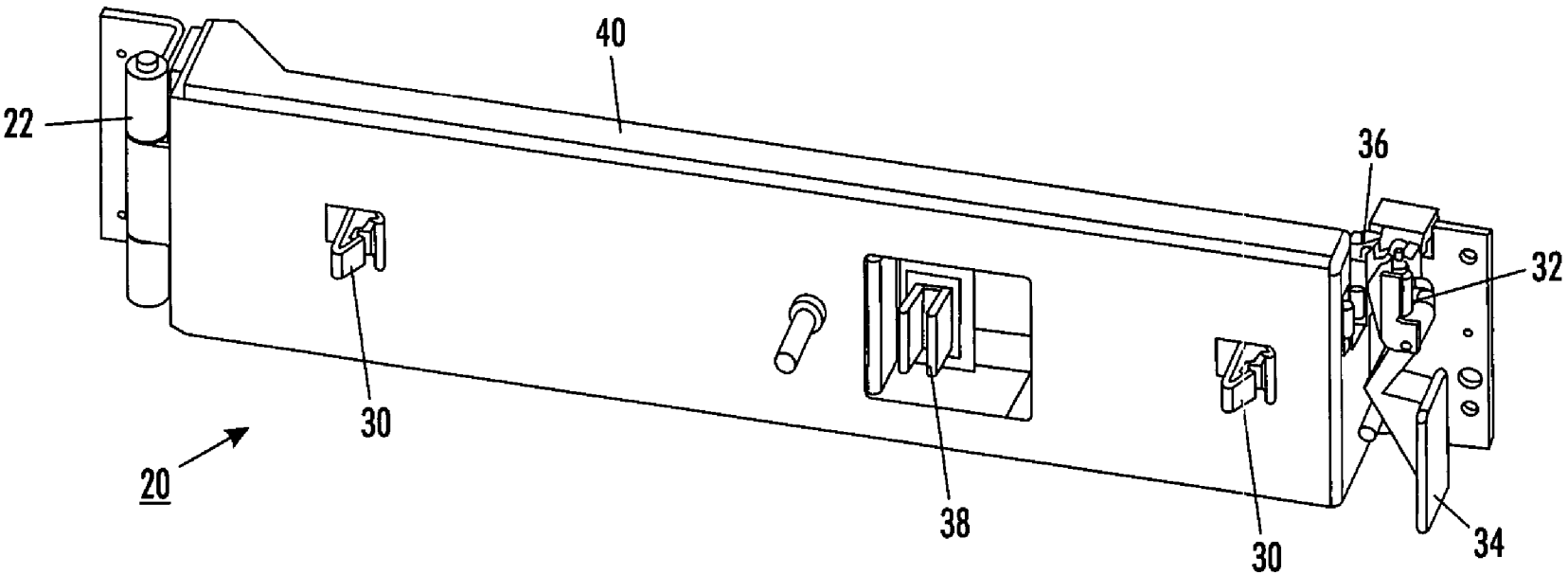
FIG. 3 is a perspective view of a portion of a finisher module, in isolation.

FIG. 3 shows an embodiment of an attachment member 20, in isolation. In addition to a hinge 22, there is provided in a surface adjacent the copier 100 one or more latch hooks 30, which interact with complementary catch mechanisms (not shown) in the copier 100; of course a catch mechanism could be provided in the attachment member to catch a hook on the copier, depending on a particular design.

Further in FIG. 3, a latch is provided where the attachment member 20 contacts the main body of the finisher module when the combination of copier and finisher module is "closed." In this embodiment, one latch portion 32, with a liftable handle 34, is screwed to the main body 10 of the finisher module; this interacts with a complementary latch portion 36 attached directly to the attachment member 20. Returning to FIG. 1, it can be seen that, when the handle 34 is lifted, the latch portions 32 and 36 release attachment member 20 from contact with the main body 10, so that the main body 10 can pivot, by the action of hinge 22, away from the copier 100, forming the "open" position shown in FIG. 2. In this embodiment, when the copier is ready to operate, the combination of copier and finishing module can be simply slammed closed, and the copier and finishing module will be properly aligned.

There may be any number of other structures associated with attachment member 20. An electrical connection is shown as 38, and various buttons and other sensors may be provided, such as to test for proper attachment of attachment member 20 to copier 100, and proper closure of latch portions 32 and 36. In this embodiment, the control-system connection between a control system within copier 100 and hardware within the finisher module is made via a standard cable connection 26, as can be seen in FIG. 2.

In possible embodiments, the attachment member can form an opening, or slot, through which sheets are transferred from the copier to the finisher module, or at least one surface of such a slot. For instance, in FIG. 3, the top surface 40 of attachment member 20 can be one surface over which a sheet would pass from the copier to the finisher module. Such a design may be useful if tolerances, such as for height, for the interfaces between modules are small.

Returning to FIG. 1, the handle 34 and latch portion 32 can be associated with a front panel 42, which provides a smooth appearance to the combination of copier and finisher. In one embodiment, the handle 34 and latch portion are permanently but movably (such as pivotably) attached to the front panel 42, and when the front panel 42 is removed (such as to service some hardware within finisher module 10), the handle 34 and latch portion 32 stay with the removed front panel. In another possible embodiment, copier 100 and finisher module 10 can be manufactured together and permanently attached through a pivotable mount such as hinge 22, with no such latch such as 30 to allow any permanent separation.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An apparatus for processing sheets, the apparatus associated with an output device, comprising:

a main body;

an attachment member, suitable for rigid attachment to the output device; and a pivotable mount for mounting the attachment member to the main body;

the output device defining a front end a back, the pivotable mount being disposed to be adjacent the back of the output device, the output device including a bumper on the back, and wherein the pivotable mount is constrained to prevent opening thereof so that no part of the apparatus extends beyond the bumper.

2. An apparatus for processing sheets, the apparatus associated with an out put device, comprising:

a main body;

an attachment member, suitable for rigid attachment to the output device; and a pivotable mount for mounting the attachment member to the main body, the attachment member including a first latch for rigid attachment to the output device and second latch for holding the attachment member to the main body.

3. The apparatus of claim 2, further comprising a cover for covering the second latch.

4. The apparatus of claim 3, wherein at least a portion of the second latch is movably attached to the cover.

5. The apparatus of claim 2, the main body including a structure for performing at least one processing function on a sheet, from a group of functions including stapling, folding and hole-punching.

6. An apparatus for processing sheets, the apparatus associated with an output device, comprising:

a main body;

an attachment member, suitable for rigid attachment to the output device;

a pivotable mount for mounting the attachment member to the main body; and a constraint for limiting an opening angle of the pivotable mount.

7. The apparatus of claim 6, the constraint including a wire disposed between the attachment member and the main body.

8. An apparatus comprising:

an output device, defining a front and a back, and capable of outputting sheets;

a finisher module, capable of receiving a sheet output by the output device and performing a finishing function on the sheet; and a pivotable mount between the output device and the finisher module, the pivotable mount being disposed adjacent the back of the output device and forming an opening at the front of the output device;

the output device including a bumper on the back, and wherein the pivotable mount is constrained to prevent opening thereof so that no part of the finisher module extends beyond the bumper.

9. The apparatus of claim 8, further comprising a latch for holding the output device to the finisher module.

10. The apparatus of claim 8, the finisher module performing at least one processing function on a sheet from a group of functions including stapling, folding and hole-punching.

11. An apparatus, comprising;

an output device, defining a front and a back, and capable of outputting sheets;

a finisher module, capable of receiving a sheet output by the output device and performing a finishing function on the sheet;

a pivotable mount between the output device and the finisher module, the pivotable mount being disposed adjacent the back of the output device and forming an opening at the front of the output device; and a constraint for limiting an opening angle of the pivotable mount.

12. The apparatus of claim 11, the constraint including a wire disposed between the output device and the finisher module.

13. The apparatus of claim 11, the finisher module performing at least one processing function on a sheet from a group of functions including stapling, folding and hole-punching.

* * * * *

UNITED STATES PATENT AND TRADEMARK OFFICE

CERTIFICATE OF CORRECTION

PATENT NO. : 7,136,606 B2
APPLICATION NO. : 10/833771
DATED : November 14, 2006
INVENTOR(S) : Gary R. Rose et al.

It is certified that error appears in the above-identified patent and that said Letters Patent is hereby corrected as shown below:

On the Title Page correct the first inventor's name to read as follows:

(75) Inventors: Gary [[H]] R. Rose, Brampton (CA)

Signed and Sealed this

Tenth Day of April, 2007

JON W. DUDAS
*Director of the United States Patent and Trademark Office*